US005735783A

United States Patent [19]

Joensuu

[11] Patent Number: 5,735,783

[45] Date of Patent: Apr. 7, 1998

[54] ARRANGEMENT IN CONNECTION WITH A SPREADER ROLL DRIVE

[75] Inventor: Teuvo Joensuu, Saloinen, Finland

[73] Assignee: Raahen Tevo Oy, Saloinen, Finland

[21] Appl. No.: 655,846

[22] Filed: May 31, 1996

[30] Foreign Application Priority Data

Jun. 2, 1995 [FI] Finland ..... 952727

[51] Int. Cl.[6] ..... B21B 35/14

[52] U.S. Cl. ..... 492/15; 492/56; 492/16

[58] Field of Search ..... 492/15, 56, 39, 492/16

[56] References Cited

U.S. PATENT DOCUMENTS

| | | | |
|---|---|---|---|
| 3,386,149 | 6/1968 | Robertson . | |
| 3,478,555 | 11/1969 | Achler et al. . | |
| 3,878,883 | 4/1975 | Hazelett et al. | 164/278 |
| 3,889,334 | 6/1975 | Justus et al. | 492/15 |
| 4,006,704 | 2/1977 | Perondi | 118/50 |
| 4,552,201 | 11/1985 | Wood | 164/481 |
| 4,921,037 | 5/1990 | Bergeron et al. | 164/432 |
| 4,962,577 | 10/1990 | Kabik et al. | 492/15 |
| 5,174,002 | 12/1992 | Kusters | 29/115 |
| 5,421,259 | 6/1995 | Shiba et al. | 492/39 |
| 5,477,912 | 12/1995 | Cisko et al. | 492/15 |
| 5,483,811 | 1/1996 | Miller | 492/39 |

FOREIGN PATENT DOCUMENTS 39 19 424 A1 12/1990 Germany .

*Primary Examiner*—Larry I. Schwartz
*Assistant Examiner*—Marc W. Butler
*Attorney, Agent, or Firm*—Burns, Doane, Swecker & Mathis LLP

[57] ABSTRACT

The invention relates to an arrangement in connection with a spreader roll drive where the driving motor (6) is directly connected to one end of the spreader roll (1). The supports (4, 5) of the spreader roll (1) comprise rubber rings (19) which are flexible and will receive the angular changes. The motor (6) shaft (8) comprises an extension shaft (14), connected to rotate the roll segments (3) placed on bearings on the arched shaft (2).

6 Claims, 1 Drawing Sheet

ARRANGEMENT IN CONNECTION WITH A SPREADER ROLL DRIVE

The invention relates to an arrangement in connection with a spreader roll drive, the arrangement comprising supporters supporting both ends of the spreader roll, a motor for driving the spreader roll, a fixed, bent shaft on which a plurality of flexibly coupled up roll segments is rotatably arranged, and a gear with a drive for changing the angle of the fixed shaft around its centre axis. The driving motor rotates the roll segments around the fixed shaft to make the roll follow the arched shape of the fixed shaft.

An arched, bent spreader roll may be used for spreading for instance web material, such as paper, textiles and film webs. Several arrangements are known from prior art of flexibly coupling up roll segments to transmit torque from one segment to another.

The construction of the spreader roll, where the roll segments rotate around a fixed shaft, has complicated the placement of the drive. In previously known constructions the fixed shaft has been supported by spherical bearings, which have formed the support. The spherical surface has allowed rotation of the fixed shaft, causing a change in the angle between the support and the shaft. Until now, the actual driving motor has been connected to the support structure of the driving end so that a worm gear has been placed on the outer periphery of the spherical surface, where it has been allowed to rotate, driven by a transverse worm screw. A support containing a worm gear has an expensive structure. Moreover, the driving motor is placed transversely against the fixed shaft. The previously known construction also includes a plurality of sliding surfaces that are quite arduous to maintain and expensive to manufacture. Adjustment of the speed of rotation of electric motors is quite advanced, and thus there is no need to use reduction gears in present drives.

It is an object of the present invention to simplify the use of a spreader roll and provide a modern arrangement of connecting the drive. Significant advantages compared with known solutions are achieved by connecting the driving motor directly to the end of the spreader roll.

More exactly, the arrangement in connection with a spreader roll drive is characterized by what is set forth in the characterizing parts of the attached claims.

The arrangement of the invention significantly improves the construction and reduces its costs. The supports may be of rolling bearing type with a diameter smaller than in previous constructions. The locations of the supports may be more freely chosen as the driving motor is directly at the other end of the spreader roll. In the arrangement of the invention no cogwheels are needed as the drive is directly connected to the spreader roll by means of a separate clutch and an extension shaft of the motor shaft. In the solution of the invention the supports of the spreader roll are also essentially simplified. The supports comprise a metal ring with a flexible rubber ring inside for receiving the angular changes caused by the arching of the spreader roll. In the invention the support also operates as a spring and it will sustain the stresses it will be subjected to better than the spherical metal surfaces.

In the following the invention will be described in greater detail with reference to the accompanying drawings.

Figure 1:
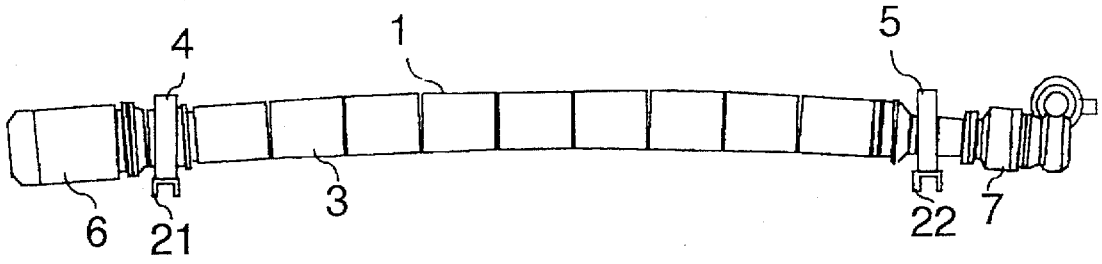
FIG. 1 shows an arched spreader roll and an arrangement in connection with the drive.
Figure 2:
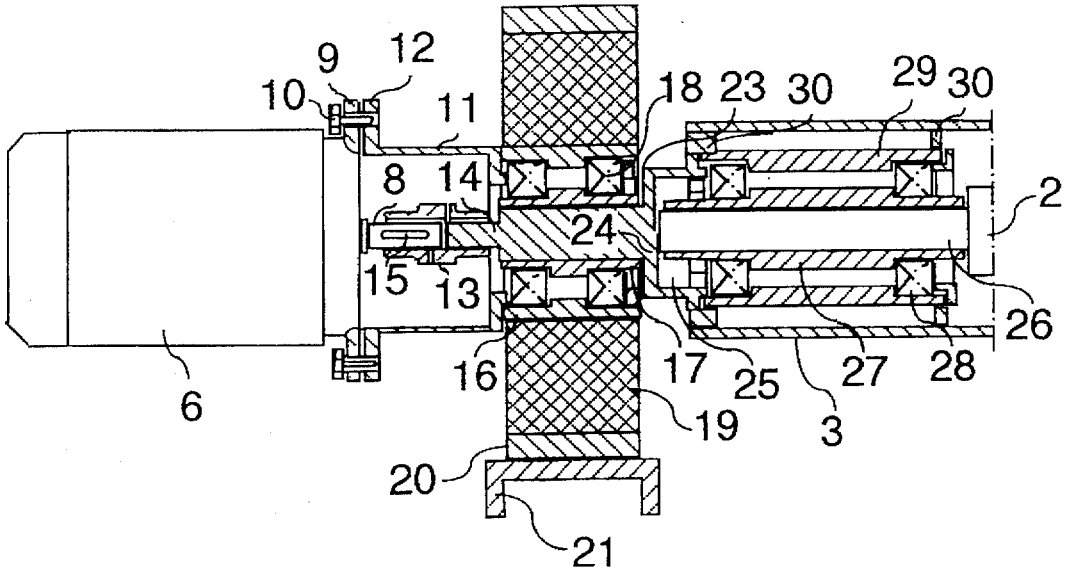
FIG. 2 shows the arrangement in connection with the spreader roll drive in partial cross section.

In FIGS. 1 and 2, numeral 1 denotes a spreader roll. Numeral 2 denotes a fixed shaft of the spreader roll.

Numeral 3 denotes parts of a roll jacket, i.e. roll segments, arranged on the shaft 2. Numerals 4 and 5 denote supports of the spreader roll. A driving motor is denoted by numeral 6. The shaft 2 is rotated by a gear 7. A motor 6 shaft is denoted by numeral 8. A motor 6 flange 9 is fastened by means of screws 10 to a flange 12 in a clutch housing 11. A clutch 13 connects the motor 6 shaft 8 and an extension shaft 14. The motor 6 shaft 8 and the extension shaft 14 comprise wedges 15 or the like, by means of which they will be locked into the clutch 13. A bearing cap 16 is rigidly fastened at its end to the clutch housing 11. A bushing 17 is arranged on the extension shaft 14 and rolling bearings 18 are arranged between the bushing 17 and the bearing cap 16. The bearing cap 16 is arranged inside a rubber ring 19 or the like, placed inside the support 4. The support 4 is strengthened with a metal ring 20, fastened to a beam 21. The construction of the support 5 is similar to that of the support 4 and it is fastened to a beam 22. One end of the extension shaft 14 comprises a shoulder 23 and an enlargement 24, at the end of which an aperture 25 is arranged for the shaft 2. The end of the shaft 2 comprises a thinner section 26, around which a bushing 27 is arranged. Bearings 28 are arranged in the bushing 27. A cover 29 for the bearings 28 is fastened to the segment 3. The bearing 28 cover 29, the enlargement 24 of the extension shaft 14 and the segment 3 are coupled up so that they rotate around the shaft 2. The segment 3 and the bearing 28 cover 29 are coupled up by means of support blocks 30.

The arrangement in connection with the spreader roll drive operates in the following way. The roll segments 3, flexibly coupled up and placed on bearings on the arched shaft, rotate around the shaft 2 and follow the shape of the shaft. The operating speed of the motor 6 is adjusted by means of a frequency transformer or the like. The motor 6 shaft 8 is via the clutch 13 directly connected to the extension shaft 14, which is via its enlargement 24 connected to the segment 3, farthest at the end near the motor 6. Because of the rolling bearing arrangement formed by the bearings 28, the segment 3 rotates around the shaft 20. An angle conforming to the thinner section 26 of the shaft 2 determines the position of the extension shaft 14 and, via the therein arranged rolling bearings 18, the position of the bearing cap 16. Being flexible, the rubber ring 19 of the support 4 yields and the bearing cap 16 is placed in a position determined by the thinner section 26 of the shaft. The clutch 13 housing 11 is rigidly fastened to the bearing cap 16 and the motor 6 is fastened by means of flanges 9, 12 to the clutch 13 housing 11. Because of the rubber ring 19 and the clutch 13, the coupling of the motor 6 shaft 8 is, however, not completely rigid, but shows certain flexibility.

It will be understood by those skilled in the art that the above is a description of one embodiment of the invention only. Within the scope of the inventive idea, the machine element solutions applied to the arrangement of the invention may be modified quite widely. The extension shaft 14 may be of another type than in the above described solution, and it may be fastened to the segment in a different way than in the solution of this application. The bearings 18 and 28 may be realized as a different solution, and their places may be somewhat changed. Moreover, the number of bearings may be different than in the above described embodiment. A different type of clutch may be used in place of the clutch 13.

I claim:

1. Arrangement in connection with a spreader roll drive, the arrangement comprising:

supporters supporting both ends of a spreader roll, a motor for driving the spreader roll, a fixed, bent shaft on which a plurality of flexibly coupled roll segments are rotatably arranged, and a gear with a drive for changing an angle of the fixed shaft around its centre axis, wherein the driving motor is directly connected to one end of the spreader roll in the axial direction by a motor flange rigidly fastened to a flange of a clutch housing and a bearing cap is rigidly fastened at its end to the clutch housing, and the supporters of the spreader roll include flexible rings which will thus receive angular changes caused by an arching of the spreader roll.

2. Arrangement in connection with a spreader roll drive as claimed in claim 1, wherein the clutch housing includes a clutch connecting a shaft of the motor to an extension shaft, the bearing cap of the extension shaft being arranged inside the flexible ring of one of the supporters.

3. Arrangement in connection with a spreader roll drive as claimed in claim 1, wherein the motor is rigidly fastened to the flange of the clutch housing by screws.

4. Arrangement in connection with a spreader roll drive as claimed in claim 1, wherein an end of an extension shaft on a side of the spreader roll comprises an enlargement with an aperture for the end of the fixed shaft.

5. Arrangement in connection with a spreader roll drive as claimed in claim 1, wherein one of the plurality of segments located at an end of the fixed shaft near the motor is connected by means of a support block to an enlargement of an extension shaft and a bearing cover.

6. Arrangement in connection with a spreader roll drive as claimed in claim 1, wherein said flexible rings are rubber.

* * * * *